US010100777B2

(12) United States Patent
Yoo et al.

(10) Patent No.: US 10,100,777 B2
(45) Date of Patent: Oct. 16, 2018

(54) PISTON FOR INTERNAL COMBUSTION ENGINE, AND COOLING CHANNEL CORE

(71) Applicant: DONG YANG PISTON CO., LTD., Gyeonggi-do (KR)

(72) Inventors: In Cheol Yoo, Gyeonggi-do (KR); Woo Seok Shim, Gyeonggi-do (KR); Sang Hyuk Jun, Gyeonggi-do (KR); Jeong Keon Lee, Incheon (KR); Kwan Ho Ryu, Gyeonggi-do (KR); Jun Kui Yang, Seoul (KR)

(73) Assignee: DONG YANG PISTON CO., LTD., Gyeonggi-Do (KR)

( * ) Notice: Subject to any disclaimer, the term of this patent is extended or adjusted under 35 U.S.C. 154(b) by 187 days.

(21) Appl. No.: 15/164,201

(22) Filed: May 25, 2016

(65) Prior Publication Data

US 2017/0314504 A1 Nov. 2, 2017

(30) Foreign Application Priority Data

May 2, 2016 (KR) ..... 10-2016-0054197

(51) Int. Cl.

| | |
|---|---|
| ***F02F 3/20*** | (2006.01) |
| ***F02F 3/00*** | (2006.01) |
| ***B22C 9/10*** | (2006.01) |
| ***F01P 3/10*** | (2006.01) |
| ***F02F 3/22*** | (2006.01) |

(52) U.S. Cl.

CPC ..... *F02F 3/20* (2013.01); *B22C 9/105* (2013.01); *F01P 3/10* (2013.01); *F02F 3/0015* (2013.01); *F02F 3/22* (2013.01); *F02F 2200/08* (2013.01)

(58) Field of Classification Search

CPC ..... F02F 3/20; F02F 3/0015

See application file for complete search history.

(56) References Cited

U.S. PATENT DOCUMENTS

2011/0192359 A1* 8/2011 Kim ..... F02F 3/22 123/41.35

FOREIGN PATENT DOCUMENTS

| | | | | |
|---|---|---|---|---|
| DE | 102004060546 A1 | | 6/2006 | |
| DE | 102008002571 A1 | | 12/2009 | |
| EP | 0855499 A1 | | 7/1998 | |
| JP | 02-118151 | | 9/1990 | |
| JP | 2009215978 | | 9/2006 | |
| JP | 23524958 | | 9/2011 | |
| JP | 2012-237229 | | 12/2012 | |
| JP | 2014-084790 | | 5/2014 | |
| JP | 2014-185522 | | 10/2014 | |
| KR | 20130123702 A | * | 11/2013 | ..... F02F 3/22 |

* cited by examiner

*Primary Examiner* — Jacob Amick
*Assistant Examiner* — Charles Brauch
(74) *Attorney, Agent, or Firm* — Mayer & Williams, PC; Stuart H. Mayer

(57) ABSTRACT

Provided is a piston for an internal combustion engine, the piston including a body having a piston pin boss for inserting a piston pin thereinto, and a skirt corresponding to a cylinder wall, and a cooling channel provided in the body to allow a refrigerant for cooling the body, to flow therethrough, and having a ring shape including a first channel provided from a refrigerant inlet to a refrigerant outlet along a first outer circumferential direction of the body, and a second channel provided from the refrigerant inlet to the refrigerant outlet along a second outer circumferential direction of the body.

7 Claims, 9 Drawing Sheets

PISTON FOR INTERNAL COMBUSTION ENGINE, AND COOLING CHANNEL CORE

CROSS-REFERENCE TO RELATED PATENT APPLICATION

This application claims the benefit of Korean Patent Application No. 10-2016-0054197, filed on May 2, 2016, in the Korean Intellectual Property Office, the disclosure of which is incorporated herein in its entirety by reference.

BACKGROUND

1. Field

The present invention relates to a piston for an internal combustion engine, and a cooling channel core and, more particularly, to a piston reciprocating in a cylinder of an internal combustion engine and receiving the pressure of high-temperature and high-pressure explosion in a combustion process to provide motive power to a crankshaft through a connecting rod, and a cooling channel core.

2. Description of the Related Art

In general, a diesel engine, which is a high-temperature and high-pressure compression ignition engine, has a very high combustion temperature and thus the temperature of a piston thereof is much higher than that of a gasoline engine. As such, a piston ring is burnt, thermal fatigue stress of the piston is increased, and thus the engine is damaged.

To prevent the above problem, a piston of a diesel engine or a gasoline engine includes a cooling channel to cool the piston. The cooling channel is provided at the center of the piston in a ring shape using a coring method, and an oil inlet and an oil outlet are provided at two sides thereof. That is, oil scattered due to pumping of an oil pump during vertical reciprocation of the piston is supplied through the oil inlet, circulates through the cooling channel to cool the piston, and then is discharged through the oil outlet.

In a conventional piston for an internal combustion engine, a cooling channel is generated using a coring method in a piston casting process, and a ceramic core formed of a ceramic material or a salt core formed of compressed salt is used for coring. That is, a ring is generated using a ceramic material or compressed salt and two pillars are provided to support the ring. One of two holes generated due to the pillars serves as the oil inlet and the other thereof serves as the oil outlet after the casting process.

However, when the conventional piston moves upward at high speed in a direction from a location close to an engine oil spray to a location far from the same, the engine oil flows backward in the cooling channel and thus is discharged not only through a refrigerant outlet but also through a refrigerant inlet. As such, cooling efficiency of the piston is lowered.

SUMMARY

The present invention provides a piston for an internal combustion engine, and a cooling channel core, the piston and the cooling channel core capable of inducing engine oil to flow from an refrigerant inlet to a refrigerant outlet in a cooling channel of the piston. However, the scope of the present invention is not limited thereto.

According to an aspect of the present invention, there is provided a piston for an internal combustion engine, the piston including a body including a piston pin boss for inserting a piston pin thereinto, and a skirt corresponding to a cylinder wall, and a cooling channel provided in the body to allow a refrigerant for cooling the body, to flow therethrough, and having a ring shape including a first channel provided from a refrigerant inlet to a refrigerant outlet along a first outer circumferential direction of the body, and a second channel provided from the refrigerant inlet to the refrigerant outlet along a second outer circumferential direction of the body, wherein, in the cooling channel, to increase a supply speed and a discharge speed of the refrigerant by inducing the refrigerant supplied through the refrigerant inlet, toward the refrigerant outlet, a first space cross-sectional area of a first part of the first channel located relatively close to the refrigerant inlet is less than a second space cross-sectional area of a second part of the first channel located relatively far from the refrigerant inlet, and a third space cross-sectional area of a third part of the second channel located relatively close to the refrigerant outlet is less than a fourth space cross-sectional area of a fourth part of the second channel located relatively far from the refrigerant outlet.

The cooling channel may have a ring shape in which a lower surface height is equal at every part, an upper surface height of the first part is greater than an upper surface height above the refrigerant inlet, and an upper surface height of the second part is greater than the upper surface height of the first part, and the first channel and the second channel may have point symmetry with respect to a center point of a virtual line connected between the refrigerant inlet and the refrigerant outlet.

The space cross-sectional area of the second part may be 1.05 to 1.30 times greater than the space cross-sectional area of the first part.

A height of an upper surface of the cooling channel may be continuously changed from above the refrigerant inlet to the first part.

An instantaneous tilt angle of a tangent to the upper surface may be rapidly increased from above the refrigerant inlet to the first part.

A height of an upper surface of the cooling channel may be continuously changed from the first part to the second part.

An instantaneous tilt angle of a tangent to the upper surface may be slowly reduced from the first part to the second part.

The cooling channel may have a shape in which an upper surface height is equal and a lower surface height is also equal at every part, and a width of a space cross-section of the second part is greater than a width of a space cross-section of the first part.

The first channel may have a space cross-sectional area gradually increased from the refrigerant outlet to the refrigerant inlet, and the second channel may have a space cross-sectional area gradually increased from the refrigerant inlet to the refrigerant outlet.

The first channel and the second channel may have an equal channel width, and extensions having an extended width or an extended length greater than the channel width may be provided under the refrigerant inlet and the refrigerant outlet.

According to another aspect of the present invention, there is provided a cooling channel core including a core body inserted into a casting mold in a piston casting operation to generate a cooling channel, and having a ring shape including a refrigerant inlet's counterpart provided at a side thereof, a refrigerant outlet's counterpart provided at another side thereof, a first channel's counterpart provided from the refrigerant inlet's counterpart to the refrigerant outlet's counterpart along a first outer circumferential direction, and a second channel's counterpart provided from the refrigerant inlet's counterpart to the refrigerant outlet's counterpart along a second outer circumferential direction, a first part's counterpart provided in the first channel's counterpart of the core body, located relatively close to the refrigerant inlet's counterpart, and having a first cross-sectional area, a second part's counterpart provided in the first channel's counterpart of the core body, located relatively far from the refrigerant inlet's counterpart, and having a second cross-sectional area greater than the first cross-sectional area, a third part's counterpart provided in the second channel's counterpart of the core body, located relatively close to the refrigerant outlet's counterpart, and having a third cross-sectional area, and a fourth part's counterpart provided in the second channel's counterpart of the core body, located relatively far from the refrigerant outlet's counterpart, and having a fourth cross-sectional area greater than the third cross-sectional area.

The first part's counterpart and the second part's counterpart may have an equal lower surface height, an upper surface height of the first part's counterpart may be greater than an upper surface height above the refrigerant inlet's counterpart, an upper surface height of the second part's counterpart may be greater than the upper surface height of the first part's counterpart, and the first channel's counterpart and the second channel's counterpart may have point symmetry with respect to a center point of a virtual line connected between the refrigerant inlet's counterpart and the refrigerant outlet's counterpart.

The cooling channel core may have a shape in which the first part's counterpart and the second part's counterpart have an equal upper surface height and an equal lower surface height, and a width of a cross-section of the second part's counterpart is greater than a width of a cross-section of the first part's counterpart.

The first channel's counterpart may have a space cross-sectional area gradually increased from the refrigerant outlet's counterpart to the refrigerant inlet's counterpart, and the second channel's counterpart may have a space cross-sectional area gradually increased from the refrigerant inlet's counterpart to the refrigerant outlet's counterpart.

The first channel's counterpart and the second channel's counterpart may have an equal channel width, and extensions having an extended width or an extended length greater than the channel width may be provided under the refrigerant inlet's counterpart and the refrigerant outlet's counterpart.

The core body may be a ceramic-based or salt-based core body.

BRIEF DESCRIPTION OF THE DRAWINGS

The above and other features and advantages of the present invention will become more apparent by describing in detail embodiments thereof with reference to the attached drawings in which.

DETAILED DESCRIPTION

Figure 1:
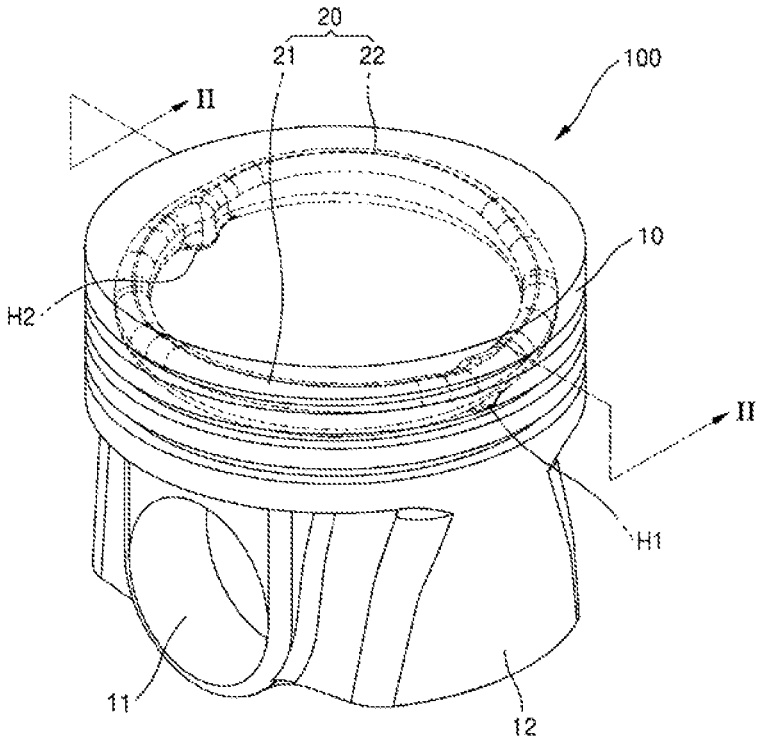
FIG. 1 is a perspective view of a piston for an internal combustion engine, according to an embodiment of the present invention.

Hereinafter, the present invention will be described in detail by explaining embodiments of the invention with reference to the attached drawings.

The invention may, however, be embodied in many different forms and should not be construed as being limited to the embodiments set forth herein; rather, these embodiments are provided so that this disclosure will be thorough and complete, and will fully convey the concept of the invention to one of ordinary skill in the art. In the drawings, the thicknesses or sizes of layers are exaggerated for clarity.

As mentioned herein, a piston for an internal combustion engine may linearly reciprocate in a cylinder, provide motive power generated due to a high-temperature and high-pressure gas, to a crankshaft through a connecting rod to generate a rotational force in a combustion process, and operate by receiving power from the crankshaft in suction, compression, and exhaust processes.

Figure 2:
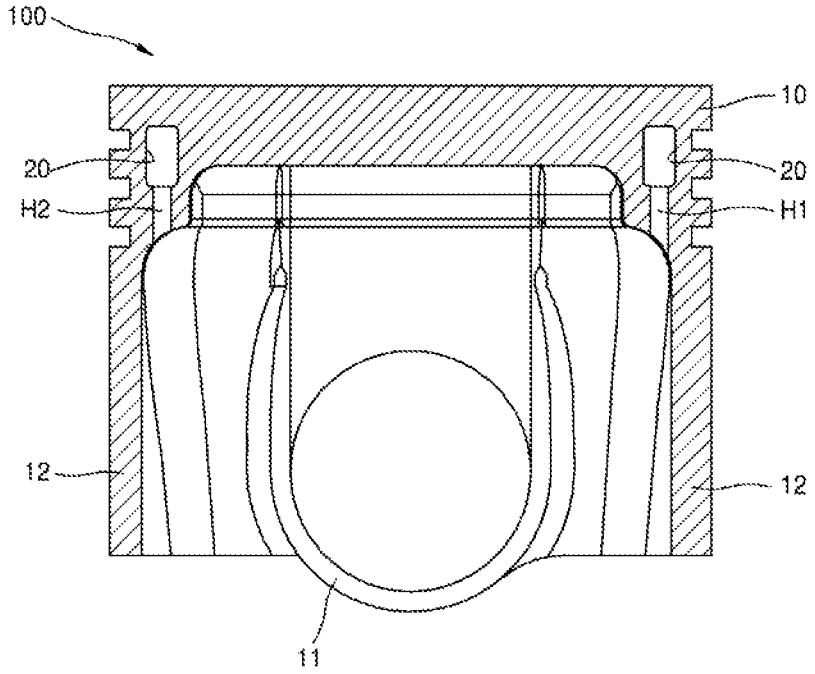
FIG. 2 is a cross-sectional view taken along line II-II of the piston of FIG. 1.
Figure 3:
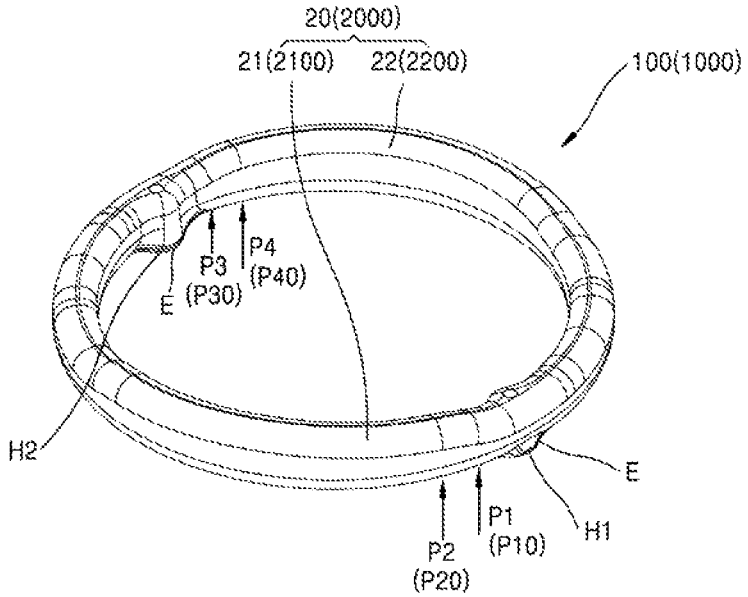
FIG. 3 is a perspective view showing an example of a cooling channel or a cooling channel core of the piston of FIG. 1.
Figure 4:
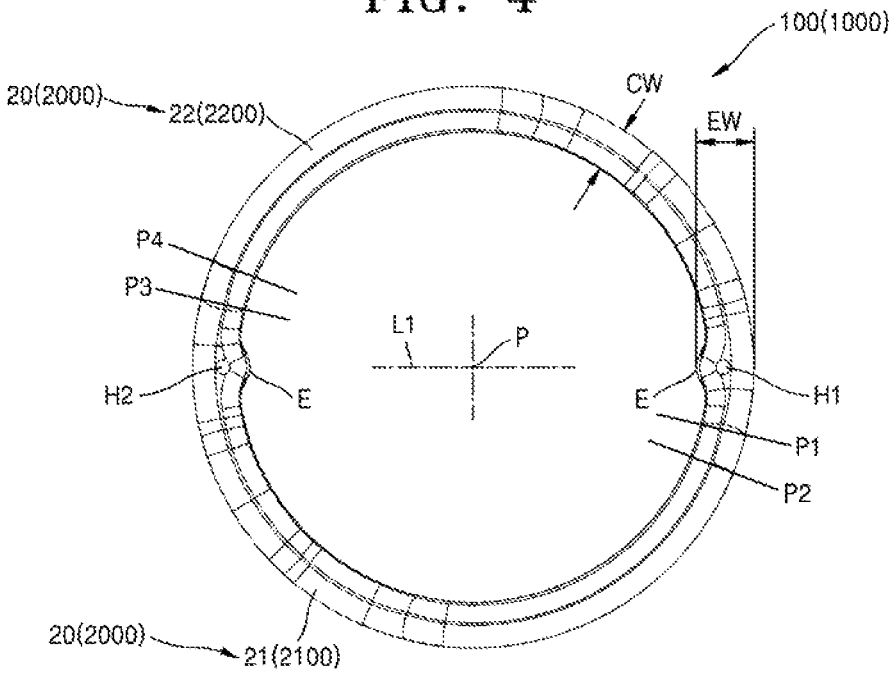
FIG. 4 is a plan view of FIG. 3.
Figure 5:
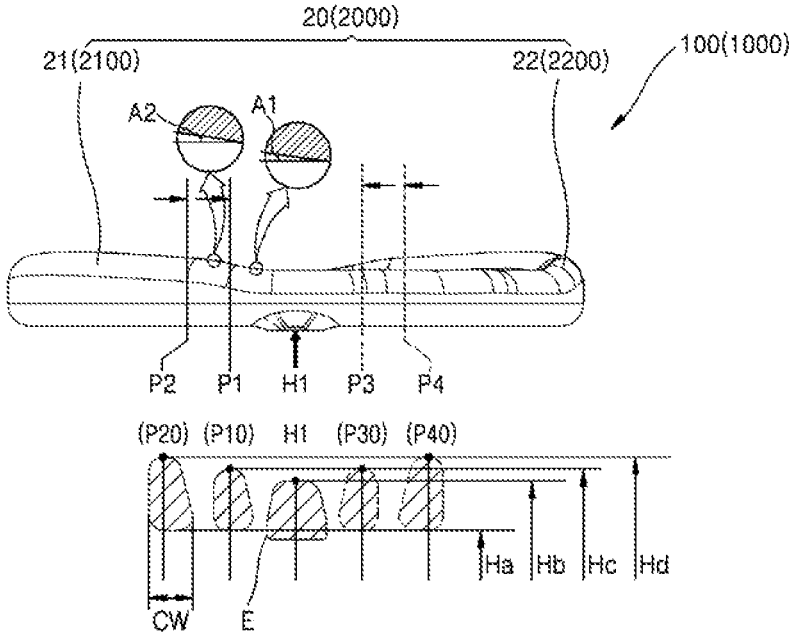
FIG. 5 is a side view of FIG. 3.
Figure 6:
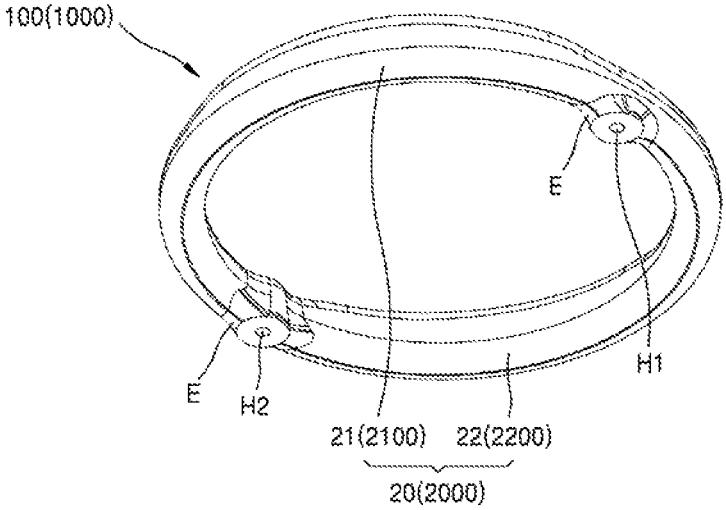
FIG. 6 is a bottom perspective view of FIG. 3.

FIG. 1 is a perspective view of a piston 100 for an internal combustion engine, according to an embodiment of the present invention, FIG. 2 is a cross-sectional view taken along line II-II of the piston 100 of FIG. 1, FIG. 3 is a perspective view showing an example of a cooling channel 20 or a cooling channel core 1000 of the piston 100 of FIG. 1, FIG. 4 is a plan view of FIG. 3, FIG. 5 is a side view of FIG. 3, and FIG. 6 is a bottom perspective view of FIG. 3.

As illustrated in FIGS. 1 to 6, the piston 100 according to an embodiment of the present invention may include a body 10 and the cooling channel 20.

For example, the body 10 may include a piston pin boss 11 for inserting a piston pin (not shown) thereinto, and a skirt 12 corresponding to a cylinder wall. Specifically, for example, the piston pin is a pin for connecting the piston pin boss 11 to a small end of a connecting rod (not shown), and may provide great power received by the piston 100, to a crankshaft through the connecting rod and, at the same time, reciprocate together with the piston 100 at high speed in a cylinder.

As illustrated in FIGS. 1 and 2, the body 10 may be applied to both a gasoline engine and a diesel engine, may generally include a cast iron component or an aluminum component, and may be a cylindrical structure having a closed end and an open end and having a sufficient strength and durability against high temperature and high pressure of an internal combustion engine. However, the body 10 is not limited to the above-described material, type, and shape and may be variously changed.

As illustrated in FIGS. 3 to 6, for example, the cooling channel 20 may be a refrigerant channel extending from a refrigerant inlet H1 provided at a side of the body 10 to a refrigerant outlet H2 provided at another side of the body 10 such that a refrigerant, e.g., cooling oil, for cooling the body 10 may flow therethrough.

More specifically, for example, the cooling channel 20 may be a ring-shaped channel including a first channel 21 and a second channel 22.

Here, the first channel 21 may be provided from the refrigerant inlet H1 to the refrigerant outlet H2 along a first outer circumferential direction of the body 10 in such a manner that a portion of the refrigerant supplied through the refrigerant inlet H1 flows in the first outer circumferential direction to cool the body 10 and then is discharged through the refrigerant outlet H2.

The second channel 22 may be provided from the refrigerant inlet H1 to the refrigerant outlet H2 along a second outer circumferential direction of the body 10 in such a manner that another portion of the refrigerant supplied through the refrigerant inlet H1 flows in the second outer circumferential direction to cool the body 10 and then is discharged through the refrigerant outlet H2.

As illustrated in FIGS. 3 to 6, in the cooling channel 20, to increase a supply speed and a discharge speed of the refrigerant by inducing the refrigerant supplied through the refrigerant inlet H1, toward the refrigerant outlet H2, a first space cross-sectional area of a first part P1 of the first channel 21 located relatively close to the refrigerant inlet H1 may be less than a second space cross-sectional area of a second part P2 of the first channel 21 located relatively far from the refrigerant inlet H1, and a third space cross-sectional area of a third part P3 of the second channel 22 located relatively close to the refrigerant outlet H2 may be less than a fourth space cross-sectional area of a fourth part P4 of the second channel 22 located relatively far from the refrigerant outlet H2.

Here, a space cross-sectional area may refer to a cross-sectional area of a space defined when the first channel 21 or the second channel 22 is cut along a direction perpendicular to the direction of dominant flow of the refrigerant.

As illustrated in FIG. 4, for example, the first channel 21 and the second channel 22 may have point symmetry with respect to a center point P of a virtual line L1 connected between the refrigerant inlet H1 and the refrigerant outlet H2.

Accordingly, the first part P1 and the second part P2 may be provided near the refrigerant inlet H1 and the third part P3 and the fourth part P4 may be provided near the refrigerant outlet H2 to have point symmetry with respect to the center point P.

Therefore, a refrigerant supplied through the refrigerant inlet H1 may experience a minimum resistance to the initial inflow of the refrigerant as the space cross-sectional areas increase along the first part P1 and the second part P2, and may experience a minimum resistance to the outflow of the refrigerant when flowing through the third part P3 and the fourth part P4. Then, the refrigerant may be guided along an inclined surface of an upper surface of the cooling channel 20 by the movement of the piston 100 according to an embodiment of the present invention, and then may be easily discharged through the refrigerant outlet H2.

Specifically, as illustrated in FIG. 5, for example, the cooling channel 20 may have a ring shape in which a lower surface height Ha is equal at every part, an upper surface height Hc of the first part P1 is greater than an upper surface height Hb above the refrigerant inlet H1, and an upper surface height Hd of the second part P2 is greater than the upper surface height Hc of the first part P1.

More specifically, for example, as illustrated in an enlarged part of FIG. 5, the height of the upper surface of the cooling channel 20 may be continuously changed from above the refrigerant inlet H1 to the first part P1 (or the third part P3), and an instantaneous tilt angle A1 of a tangent to the upper surface may be rapidly increased from above the refrigerant inlet H1 to the first part P1 (or the third part P3).

As illustrated in another enlarged part of FIG. 5, the height of the upper surface of the cooling channel 20 may be continuously changed from the first part P1 to the second part P2, and an instantaneous tilt angle A2 of a tangent to the upper surface may be slowly reduced from the first part P1 to the second part P2.

According to the above-described shape, since an upper surface height varies while a lower surface height is fixed, the height of the cooling channel 20 may be increased near the refrigerant inlet H1 from the refrigerant inlet H1 toward the refrigerant outlet H2, i.e., in the first channel 21, and thus a space cross-sectional area may be gradually increased.

On the contrary, in the second channel 22, the space cross-sectional area may not be changed or even may be reduced near the refrigerant inlet H1. Accordingly, if necessary, a refrigerant supplied through the refrigerant inlet H1 may be induced to the first channel 21 rather than the second channel 22 and may circulate along an arc direction due to inertia. Thus, the refrigerant may be more easily supplied and discharged.

If the difference in space cross-sectional area is excessively small, the refrigerant may not be appropriately induced. Otherwise, if the difference in the space cross-sectional area is excessively large, air bubbles may be generated or severe spatial restrictions may be caused. After repeated tests and simulations, the best results are achieved when the space cross-sectional area of the second part P2 is 1.05 to 1.30 times greater than the space cross-sectional area of the first part P1. For example, the space cross-sectional area may have a narrow upper part and a wide lower part as illustrated in FIG. 5, but the shape thereof may be variously changed.

As illustrated in FIGS. 3 to 6, for example, the first channel 21 and the second channel 22 may have an equal channel width CW, and extensions E having an extended width EW or an extended length greater than the channel width CW may be provided under the refrigerant inlet H1 and the refrigerant outlet H2.

Accordingly, the extensions E may have an inverted funnel shape to allow a high-pressure refrigerant sprayed from an oil spray nozzle (not shown), to be easily supplied into the cooling channel 20.

Figure 7:
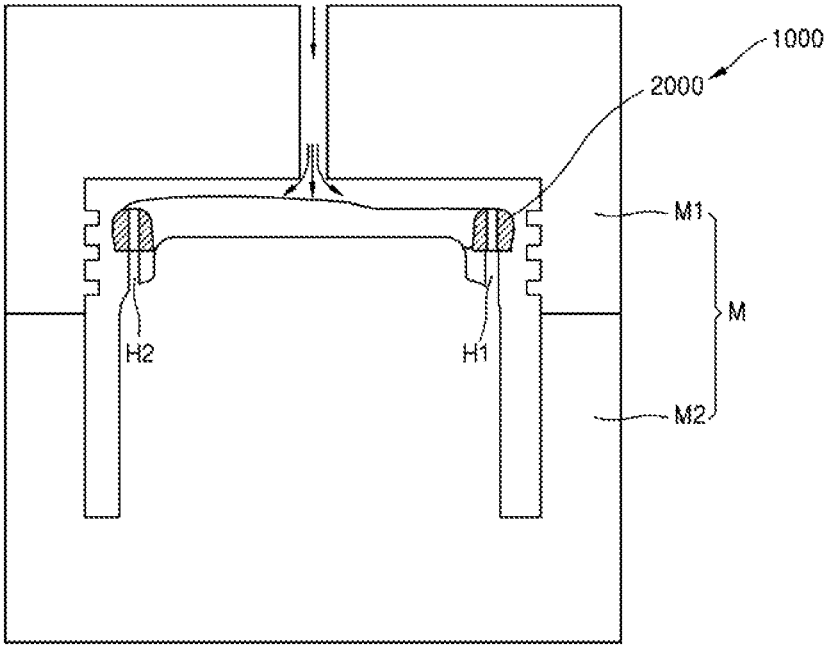
FIG. 7 is a cross-sectional view showing that the cooling channel core of FIG. 3 is inserted into a casting mold.

FIG. 7 is a cross-sectional view showing that the cooling channel core 1000 of FIG. 3 is inserted into a casting mold M.

As illustrated in FIGS. 3 to 7, the cooling channel core 1000 according to some embodiments of the present invention is a medium used to generate the above-described cooling channel 20 of the piston 100, and may include a core body 2000, a first part's counterpart P10, a second part's counterpart P20, a third part's counterpart P30, and a fourth part's counterpart P40.

As illustrated in FIGS. 3 to 7, for example, the core body 2000 may have a shape corresponding to the above-described cooling channel 20, and may be a structure which is insert-casted in the casting mold M including a first mold M1 and a second mold M2 capable of being open and closed in a piston casting operation and then is easily broken and discharged using water, a sulfuric acid solution, or strong impact to generate the cooling channel 20.

As illustrated in FIGS. 3 to 7, the core body 2000 may have a ring shape including a refrigerant inlet's counterpart provided at a side thereof, a refrigerant outlet's counterpart provided at another side thereof, a first channel's counterpart 2100 provided from the refrigerant inlet's counterpart to the refrigerant outlet's counterpart along the first outer circumferential direction, and a second channel's counterpart 2200 provided from the refrigerant inlet's counterpart to the refrigerant outlet's counterpart along the second outer circumferential direction.

The first part's counterpart P10 may be provided in the first channel's counterpart 2100 of the core body 2000, may be located relatively close to the refrigerant inlet's counterpart, and may have a first cross-sectional area.

The second part's counterpart P20 may be provided in the first channel's counterpart 2100 of the core body 2000, may be located relatively far from the refrigerant inlet's counterpart, and may have a second cross-sectional area greater than the first cross-sectional area.

The third part's counterpart P30 may be provided in the second channel's counterpart 2200 of the core body 2000, may be located relatively close to the refrigerant outlet's counterpart, and may have a third cross-sectional area.

The fourth part's counterpart P40 may be provided in the second channel's counterpart 2200 of the core body 2000, may be located relatively far from the refrigerant outlet's counterpart, and may have a fourth cross-sectional area greater than the third cross-sectional area.

Specifically, for example, as illustrated in FIG. 5, the first part's counterpart P10 and the second part's counterpart P20 may have an equal lower surface height Ha, an upper surface height Hc of the first part's counterpart P10 may be greater than an upper surface height Hb above the refrigerant inlet's counterpart, and an upper surface height Hd of the second part's counterpart P20 may be greater than the upper surface height Hc of the first part's counterpart P10.

As illustrated in FIG. 6, the first channel's counterpart 2100 and the second channel's counterpart 2200 may have point symmetry with respect to a center point P of a virtual line L1 connected between the refrigerant inlet's counterpart and the refrigerant outlet's counterpart.

As illustrated in FIGS. 3 to 6, the cooling channel 20 of the piston 100, according to some embodiments of the present invention may have a shape, form, and size corresponding to those of the cooling channel core 1000 for generating the cooling channel 20, according to some embodiments of the present invention, and the above descriptions of the shape, form, and size of the cooling channel 20 may be equally applied to the cooling channel core 1000.

Accordingly, as illustrated in FIG. 7, for example, the cooling channel core 1000 may be insert-casted in a cavity space of the casting mold M including the first mold M1 and the second mold M2 capable of being open and closed in a piston casting operation, may be supported by pillars used to generate the refrigerant inlet H1 and the refrigerant outlet H2, and then may be easily broken and discharged using water, a sulfuric acid solution, or strong impact to generate the cooling channel 20.

To guarantee durability against high temperature and high pressure of molten metal in the piston casting operation and to be easily discharged after the piston casting operation, the core body 2000 may be a ceramic-based or salt-based core body.

Therefore, cooling efficiency and flow of the refrigerant may be improved by inducing engine oil to flow from the refrigerant inlet H1 to the refrigerant outlet H2 in the cooling channel 20 of the piston 100.

Figure 8:
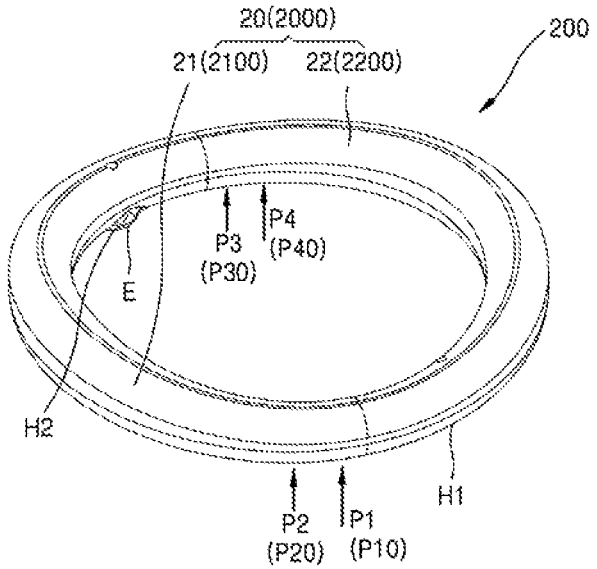
FIG. 8 is a perspective view showing an example of a cooling channel or a cooling channel core of a piston for an internal combustion engine, according to another embodiment of the present invention.
Figure 9:
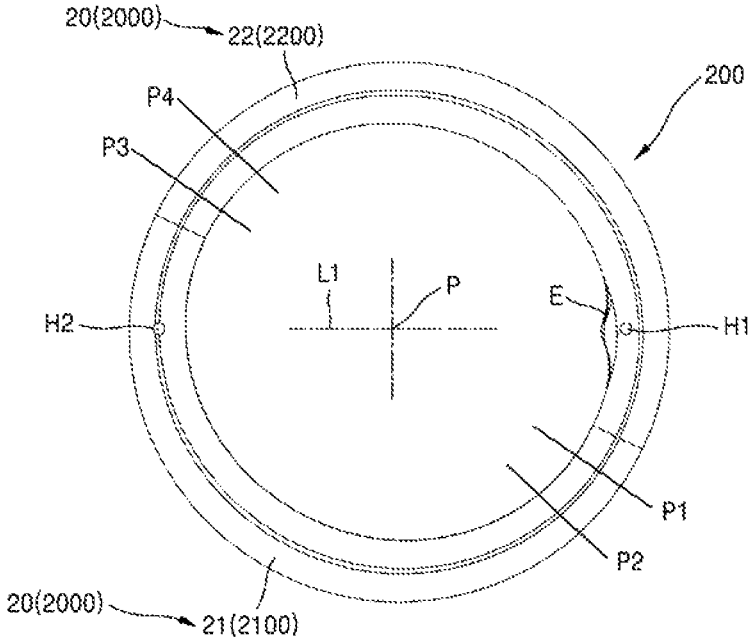
FIG. 9 is a plan view of FIG. 8.
Figure 10:
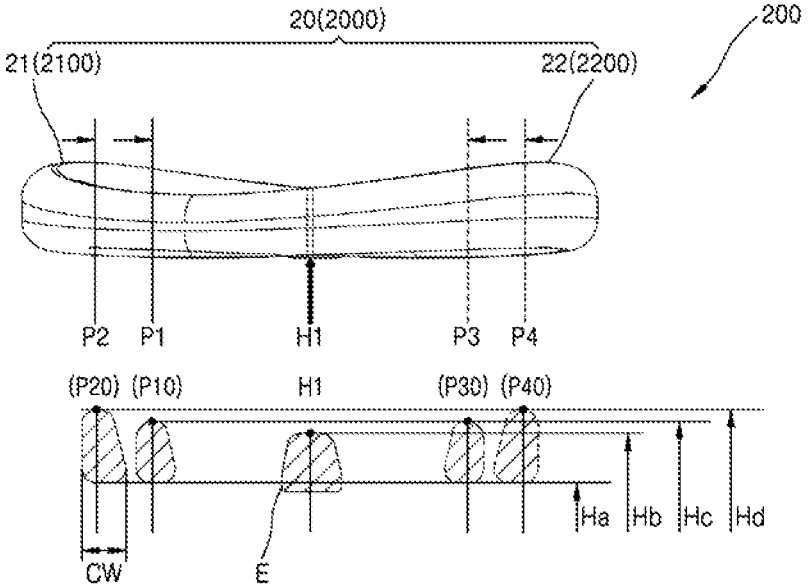
FIG. 10 is a side view of FIG. 8.
Figure 11:
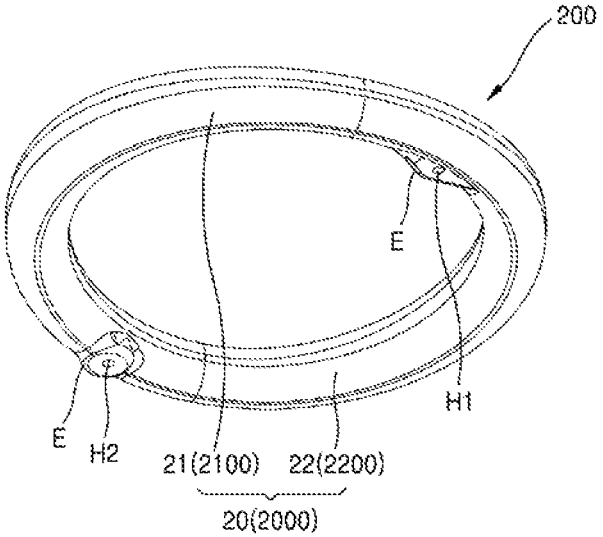
FIG. 11 is a bottom perspective view of FIG. 8.

FIG. 8 is a perspective view showing an example of a cooling channel 20 or a cooling channel core 1000 of a piston 200 for an internal combustion engine, according to another embodiment of the present invention, FIG. 9 is a plan view of FIG. 8, FIG. 10 is a side view of FIG. 8, and FIG. 11 is a bottom perspective view of FIG. 8.

As illustrated in FIGS. 8 to 11, a refrigerant inlet H1 and a refrigerant outlet H2 may not always be provided at parts having the lowest upper surface height, and may be provided at parts other than the parts having the lowest upper surface height.

As illustrated in FIG. 9, even in this case, for example, a first channel 21 and a second channel 22 may have point symmetry with respect to a center point P of a virtual line L1 connected between the refrigerant inlet H1 and the refrigerant outlet H2.

Accordingly, if necessary, a refrigerant supplied through the refrigerant inlet H1 may be induced to the first channel 21 rather than the second channel 22 and may circulate along an arc direction due to inertia. Thus, the refrigerant may be more easily supplied and discharged.

Figure 12:
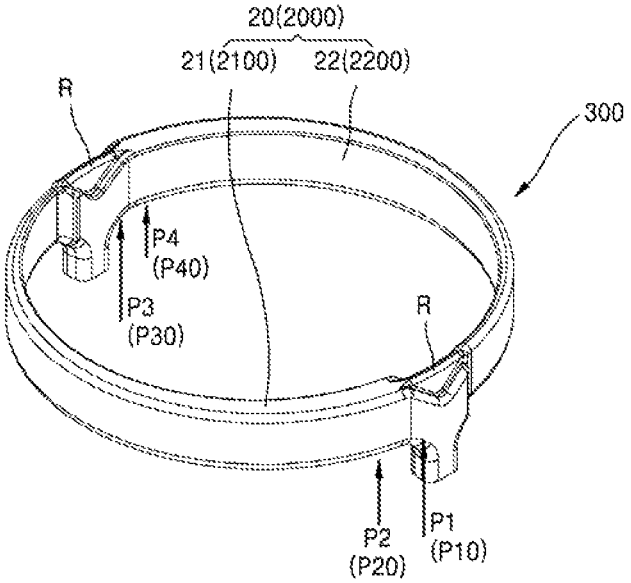
FIG. 12 is a perspective view showing an example of a cooling channel or a cooling channel core of a piston for an internal combustion engine, according to another embodiment of the present invention.
Figure 13:
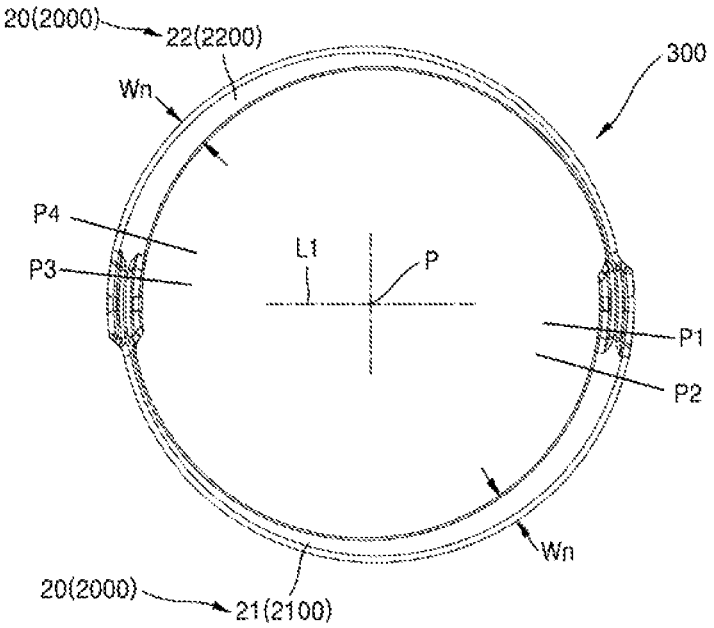
FIG. 13 is a plan view of FIG. 12.
Figure 14:
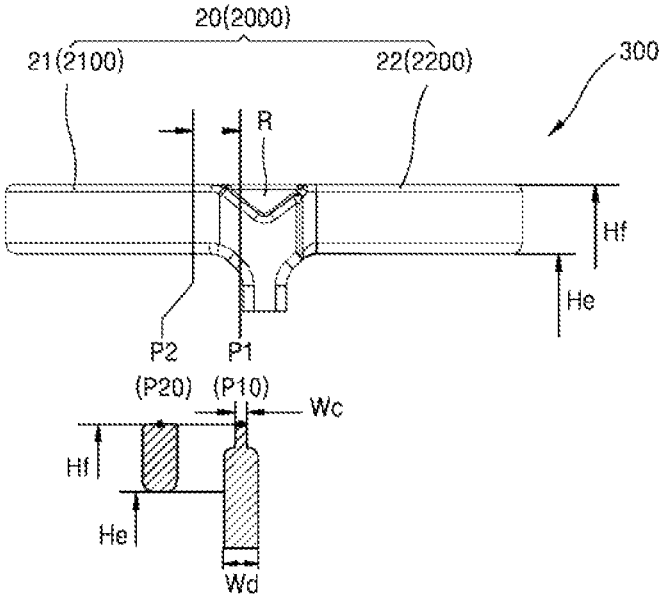
FIG. 14 is a side view of FIG. 12.
Figure 15:
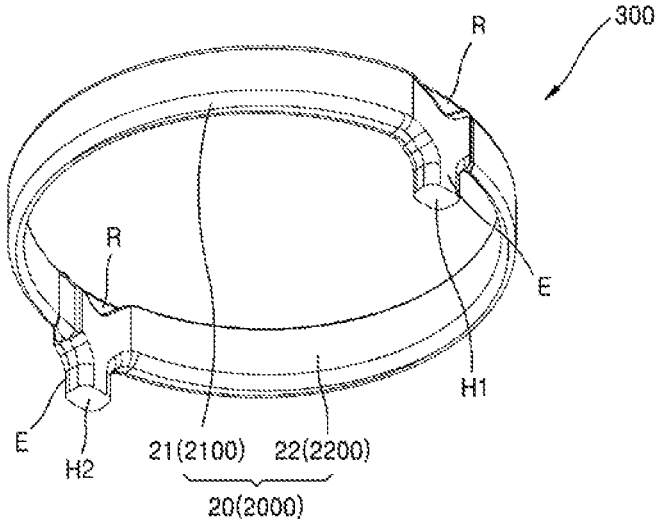
FIG. 15 is a bottom perspective view of FIG. 12.

FIG. 12 is a perspective view showing an example of a cooling channel 20 or a cooling channel core 1000 of a piston 300 for an internal combustion engine, according to another embodiment of the present invention, FIG. 13 is a plan view of FIG. 12, FIG. 14 is a side view of FIG. 12, and FIG. 15 is a bottom perspective view of FIG. 12.

As illustrated in FIG. 14, the cooling channel 20 of the piston 300 according to another embodiment of the present invention may have a shape in which an upper surface height Hf is equal and a lower surface height He is also equal at every part. Furthermore, as illustrated in FIGS. 12 and 13, a width of a space cross-section of a second part P2 is greater than a width of a space cross-section of a first part P1.

Here, a first channel 21 may have a space cross-sectional area gradually increased from a refrigerant outlet H2 to a refrigerant inlet H1, and a second channel 22 may have a space cross-sectional area gradually increased from the refrigerant inlet H1 to the refrigerant outlet H2.

Accordingly, if necessary, a refrigerant supplied through the refrigerant inlet H1 may be induced to the first channel 21 rather than the second channel 22 and may circulate along an arc direction due to inertia. Thus, the refrigerant may be more easily supplied and discharged.

As illustrated in FIGS. 12 to 15, the cooling channel core 1000 according to another embodiment of the present invention may have a shape in which a first part's counterpart P10 and a second part's counterpart P20 have an equal upper surface height Hf and an equal lower surface height He, and a width Wd of a cross-section of the second part's counterpart P20 is greater than a width Wc of a cross-section of the first part's counterpart P10.

That is, a first channel's counterpart 2100 may have a width Wn and a space cross-sectional area gradually increased from a refrigerant outlet's counterpart to a refrigerant inlet's counterpart, and a second channel's counterpart 2200 may have a width Wn and a space cross-sectional area gradually increased from the refrigerant inlet's counterpart to the refrigerant outlet's counterpart.

As illustrated in FIGS. 12 to 15, ribs R may be provided on the first part's counterpart P10 and the second part's counterpart P20.

The first channel's counterpart 2100 and the second channel's counterpart 2200 may have an equal channel width CW, and extensions E having an extended length may be provided under the refrigerant inlet's counterpart and the refrigerant outlet's counterpart.

Therefore, a refrigerant may be supplied through the refrigerant inlet H1 with the minimum resistance of flow due to increasing space cross-sectional areas, may be induced along a slope of an outer circumferential surface of the cooling channel 20 due to motion of the piston 300 according to another embodiment of the present invention, and then may be easily discharged through the refrigerant outlet H2.

In addition, the refrigerant may sufficiently reach upper parts of the refrigerant inlet H1 and the refrigerant outlet H2 due to the ribs R and thus cooling efficiency of the refrigerant inlet's counterpart and the refrigerant outlet's counterpart may be improved.

As described above, according to an embodiment of the present invention, a piston for an internal combustion engine, and a cooling channel core, the piston and the cooling channel core capable of improving piston cooling performance by inducing engine oil to flow from an refrigerant inlet to a refrigerant outlet in a cooling channel of the piston. However, the scope of the present invention is not limited to the above effect.

While the present invention has been particularly shown and described with reference to embodiments thereof, it will be understood by those of ordinary skill in the art that various changes in form and details may be made therein without departing from the spirit and scope of the present invention as defined by the following claims.

What is claimed is:

1. A piston for an internal combustion engine, the piston comprising:

a body comprising a piston pin boss for inserting a piston pin thereinto, and a skirt corresponding to a cylinder wall; and a cooling channel provided in the body to allow a refrigerant for cooling the body, to flow therethrough, and having a ring shape comprising a first channel provided from a refrigerant inlet to a refrigerant outlet along a first outer circumferential direction of the body, and a second channel provided from the refrigerant inlet to the refrigerant outlet along a second outer circumferential direction of the body, wherein, in the cooling channel, to increase a supply speed and a discharge speed of the refrigerant by inducing the refrigerant supplied through the refrigerant inlet, toward the refrigerant outlet, a first space cross-sectional area of a first part of the first channel located relatively close to the refrigerant inlet is less than a second space cross-sectional area of a second part of the first channel located relatively far from the refrigerant inlet, and a third space cross-sectional area of a third part of the second channel located relatively close to the refrigerant outlet is less than a fourth space cross-sectional area of a fourth part of the second channel located relatively far from the refrigerant outlet, wherein the first channel has a space cross-sectional area gradually increased along an entirety of the first channel from the refrigerant outlet to the refrigerant inlet, and wherein the second channel has a space cross-sectional area gradually increased along an entirety of the second channel from the refrigerant inlet to the refrigerant outlet.

2. The piston of claim 1, wherein the cooling channel has a shape in which an upper surface height is equal and a lower surface height is also equal at every part, and a width of a space cross-section of the second part is greater than a width of a space cross-section of the first part.

3. The piston of claim 1, wherein the first channel and the second channel have an equal channel width, and wherein extensions having an extended width or an extended length greater than the channel width are provided under the refrigerant inlet and the refrigerant outlet.

4. A cooling channel core comprising:

a core body inserted into a casting mold in a piston casting operation to generate a cooling channel, and having a ring shape comprising a refrigerant inlet's counterpart provided at a side thereof, a refrigerant outlet's counterpart provided at another side thereof, a first channel's counterpart provided from the refrigerant inlet's counterpart to the refrigerant outlet's counterpart along a first outer circumferential direction, and a second channel's counterpart provided from the refrigerant inlet's counterpart to the refrigerant outlet's counterpart along a second outer circumferential direction;

a first part's counterpart provided in the first channel's counterpart of the core body, located relatively close to the refrigerant inlet's counterpart, and having a first cross-sectional area;

a second part's counterpart provided in the first channel's counterpart of the core body, located relatively far from the refrigerant inlet's counterpart, and having a second cross-sectional area greater than the first cross-sectional area;

a third part's counterpart provided in the second channel's counterpart of the core body, located relatively close to the refrigerant outlet's counterpart, and having a third cross-sectional area; and a fourth part's counterpart provided in the second channel's counterpart of the core body, located relatively far from the refrigerant outlet's counterpart, and having a fourth cross-sectional area greater than the third cross-sectional area, wherein the first channel's counterpart has a space cross-sectional area gradually increased along an entirety of the first channel from the refrigerant outlet's counterpart to the refrigerant inlet's counterpart, and wherein the second channel's counterpart has a space cross-sectional area gradually increased along an entirety of the second channel from the refrigerants inlet's counterpart to the refrigerants outlet's counterpart.

5. The cooling channel core of claim 4, wherein the cooling channel core has a shape in which the first part's counterpart and the second part's counterpart have an equal upper surface height and an equal lower surface height, and a width of a cross-section of the second part's counterpart is greater than a width of a cross-section of the first part's counterpart.

6. The cooling channel core of claim 4, wherein the first channel's counterpart and the second channel's counterpart have an equal channel width, and wherein extensions having an extended width or an extended length greater than the channel width are provided under the refrigerant inlet's counterpart and the refrigerant outlet's counterpart.

7. The cooling channel core of claim 4, wherein the core body is a ceramic-based or salt-based core body.

* * * * *